US011214966B2

(12) United States Patent
Dysart

(10) Patent No.: US 11,214,966 B2
(45) Date of Patent: Jan. 4, 2022

(54) SELF VENTILATING ROOF SYSTEM

(71) Applicant: Stephen B Dysart, Warrenton, VA (US)

(72) Inventor: Stephen B Dysart, Warrenton, VA (US)

( * ) Notice: Subject to any disclaimer, the term of this patent is extended or adjusted under 35 U.S.C. 154(b) by 0 days.

(21) Appl. No.: 15/330,278

(22) Filed: Sep. 6, 2016

(65) Prior Publication Data

US 2018/0087280 A1 Mar. 29, 2018

(51) Int. Cl.
*E04D 13/17* (2006.01)
*E04B 7/02* (2006.01)

(52) U.S. Cl.
CPC ..... *E04D 13/178* (2013.01); *E04B 7/02* (2013.01); *E04D 13/172* (2013.01); *E04D 13/174* (2013.01)

(58) Field of Classification Search
CPC ... E04D 13/172; E04D 13/174; E04D 13/178; E04D 13/143; E04D 13/152; E04D 13/17; E04D 13/176; E04B 7/02; E04B 7/00
USPC ..... 52/95, 302.3
See application file for complete search history.

(56) References Cited

U.S. PATENT DOCUMENTS 2,767,961 A * 10/1956 Frankland ..... F24F 3/044 165/49
4,937,990 A * 7/1990 Paquette ..... E04D 11/02 52/199
5,473,847 A * 12/1995 Crookston ..... E04C 2/205 454/260
5,561,985 A * 10/1996 Cochran ..... F25B 30/06 62/260
6,786,013 B2 * 9/2004 Coulton ..... B32B 3/28 405/45
8,590,267 B2 * 11/2013 Jaffee ..... E04D 12/00 428/114

(Continued)

OTHER PUBLICATIONS

Web site of Oak Ridge National Laboratories, News, "ORNL helping industry establish value of cool roofs," published Nov. 1, 1999, retrieved from www.ornl.gov Nov. 27, 2019.

*Primary Examiner* — William V Gilbert

(57) ABSTRACT

A self-ventilating roofing system that comprises a rigid deck that is connected to the roof support system and has a lower horizontal opening parallel to the eave, on both slopes, and above the attic space. There is also an upper opening on either side of the ridge. A radiant barrier comprising of a reflective layer applied over the roof deck. A slice is made in the radiant barrier over the lower and upper opening of the deck to allow air to enter the lower opening and exit the upper opening. An insulated panel with vertical grooves is installed over the radiant barrier with the groove side face down. This insulated panel is made of a type of insulated material. A metal drip edge is then installed along the eave. This drip edge should be installed with an air gap between the facia and the drip edge sufficiently wide enough to allow air to enter. A vented ridge vent is then installed at the ridge to allow for the weather proof exit of the air. When a metal roof is being installed then the metal panels can be attached on top of the insulated panel. When an asphalt shingle or wood shake roof is being installed then a nailable panel must be installed over the insulated panel. The insulated panel can be made of rigid insulated pane or a flexible insulated panel with the ability to be rolled up for ease of installation.

5 Claims, 7 Drawing Sheets

(56) References Cited

U.S. PATENT DOCUMENTS

| | | | | |
|---|---|---|---|---|
| 8,973,310 | B1 * | 3/2015 | Henderson | E04D 13/178<br>52/302.1 |
| 2008/0034690 | A1 * | 2/2008 | Gartz | E04B 1/70<br>52/302.3 |
| 2008/0163565 | A1 * | 7/2008 | Toas | E04D 13/172<br>52/95 |
| 2008/0163576 | A1 * | 7/2008 | Oaten | E04D 13/174<br>52/302.3 |
| 2013/0125487 | A1 * | 5/2013 | Power | E04B 1/70<br>52/302.3 |

* cited by examiner

SELF VENTILATING ROOF SYSTEM

RELATED APPLICATIONS

This application is a Continuation In Part of Ser. No. 14/544,613 by the same title and inventors and filed Jan. 28, 2014 and priority for the common subject matter is claimed.

TECHNICAL FIELD

This invention can be applied to any roof structure, existing or new, with the result being to slow or stop radiant, convective, and direct heat from entering the roofing structure as well as the area directly below the roofing structure. This becomes an automatic non mechanical technique that works using three laws of nature, the radiant heat theory, the law of convective heat transfer and the law of hot air rising ($2^{nd}$ law of thermodynamics) This invention also exhausts humid moist air and creates a thermal break, while creating an environment where ventilation occurs naturally in the roof system and below the roof system or attic space.

BACKGROUND OF THE INVENTION

Historically speaking, the purpose of most roofing structures was to keep the structure they covered dry. That is to keep out rain, snow and wind. Originally these structures were very drafty and no thought was given to ventilating the attic or roofing structures. The challenge has become how to introduce an efficient but economic system for older structures and for new structures. Many of the older buildings were built without any eave overhangs or soffit. This prevents the standard method of introducing circulating air through a soffit vent into these older structures.

In the inventions that use ventilation to stop convective heat and a thermal break to stop direct heat none of these inventions add radiant technology to stop radiant heat. This added step addresses all three ways heat is absorbed into a roofing system.

Anthony J. Crookston, U.S. Pat. No. 5,473,847 A utilized the ventilation aspect as well as the thermal break aspect but not the radiant barrier aspect. This invention also did not allow air to enter the roofing structure under the lower eave/drip edge which meant that snow and/or ice could block this vent and keep air ventilation from occurring in the winter.

Atlas Roofing Corporation also has a similar roofing ventilation product as Mr. Crookston. This product does not use radiant barrier technology as well.

RePack has also produced similar products using a type of rigid insulation but without a radiant barrier.

Oak Ridge National Labs (ORNL) has likewise designed a roof-and-attic system that uses radiant technology but only to vent the existing hot air from the attic, Their system does not introduce new "cooler" air into the attic but exhausts the attic of existing hot air after the attic is sealed. These and other technologies by ORNL can generally be viewed at the associated Government Web site (www.ornl.gov).

In conclusion, this invention is not only unique but more effective due to the radiant technology that is included.

SUMMARY OF THE INVENTION

This invention introduces a system whereby air can be introduced under the eave drip edge and channeled into the attic, or air space under the roofing system as well as under the roofing membrane. This creates air circulation and ventilation which slows or stops the convective heat transfer into the structure. Since hot air always rises this process is automatic. The air exits the attic space as well as the roofing system through a vented ridge cap that runs the entire length of the ridge or hip in cases of a hip roof.

This invention addresses the three ways heat is transferred into a structure: direct heat transfer, think of a tea kettle on an open flame, convective heat transfer, think of the hot air in an oven cooking a turkey, and radiant heat transfer, think of popcorn in a microwave.

Direct heat transfer is slowed or stopped by using an insulated panel as a thermal break. This insulated panel is installed over the entire roof deck and due to its insulating qualities it prevent heat from being transferred from the roof surface into the structure.

Convective heat is slowed or stopped by implementing moving air to remove the convective heat. This is done by cutting in vertical grooves in the underside of the insulated panel to enable the air to move along these channels. As the roof surface heats the air the hot air will rise and exit through a vented ridge cap installed along the ridge.

Radiant heat transfer is stopped or slowed by installing a reflective membrane on the surface of the deck. Since a radiant barrier will only work if there is an air gap the grooves in the underside of the insulated panel are used in conjunction with the radiant barrier to create this air gap. The radiant heat from the sun is then reflected away from the roof structure using this method.

The Self Ventilation Roof system will utilize the three heat transfer blocking methods as well as ventilate air in the attic or space below the roof system. This is accomplished by creating an air gap under the eave drip edge so air can enter into the roof system. A small slice/gap of the roof deck, above the attic space, is created and air then will enter the attic space and exit the vented ridge cap at the apex of the roof structure. In this way both the attic space and roof system utilizes the law of hot air rising to ventilate both the attic and roof system.

These three methods are employed by this invention to offer an effective and economical way to enhance the energy efficiency of old and new structures.

To stop the radiant transfer of heat into the structure in the summer and out of the structure in the winter, a reflective water proof but vapor permeable membrane is installed over the roof deck. This serves the dual purpose of a radiant barrier as well as a waterproof membrane to dry in the structure during construction. For a radiant barrier to work there needs to be an air gap on at least one side. This reflective membrane is perforated to allow water vapor to flow through the membrane but not to allow water to penetrate the reflective membrane.

To stop or slow the direct heat transfer in the summer and the direct cold transfer in the winter a vertically grooved insulated panel is installed over the reflective membrane. If the reflective membrane is installed first the grooves are placed adjacent to the reflective membrane. If the panels are installed first then the grooves will face upward or away from the roof deck and the reflective membrane is installed on top of the grooves. This insulated panel acts as a thermal break for the entire roof system and stops or slows the direct transfer of heat or cold.

To stop the convective transfer of heat in the summer air ventilation is introduced through the air grooves in the insulated panel. Where more ventilation is needed the panels can be installed with both sides vertically grooved and the reflective membrane can be installed on the deck side of the panel or upper side. This system allows air to be heated under the roof system by the heat of sun on the roof surface being transferred to the air in the air grooves of the insulated and grooved panel. As the air heats it rises and exits out the vented ridge cap. As hot air exits the vented ridge cap cooler air is drawn in under the eave drip edge and is channeled vertically up the grooves in the insulated panel.

To ventilate the attic space more effectively a horizontal slice/gap is cut in the roof deck is made about 1 to 2 feet above where the vertical outside support wall intersects the roof structure. In this way the air that flows up the insulated panel will also enter the attic and help ventilate the attic space by exiting through a parallel space introduced at the ridge of the roof. As hot air exits through the vented ridge vent more cool air is pulled in behind the offset eave drip edge and through existing soffit vents if any.

This entire roof system can be used on any pitch of roof and can accept any profile or type of roofing material.

DETAILED DESCRIPTION

FIG. 1

Figure 1:
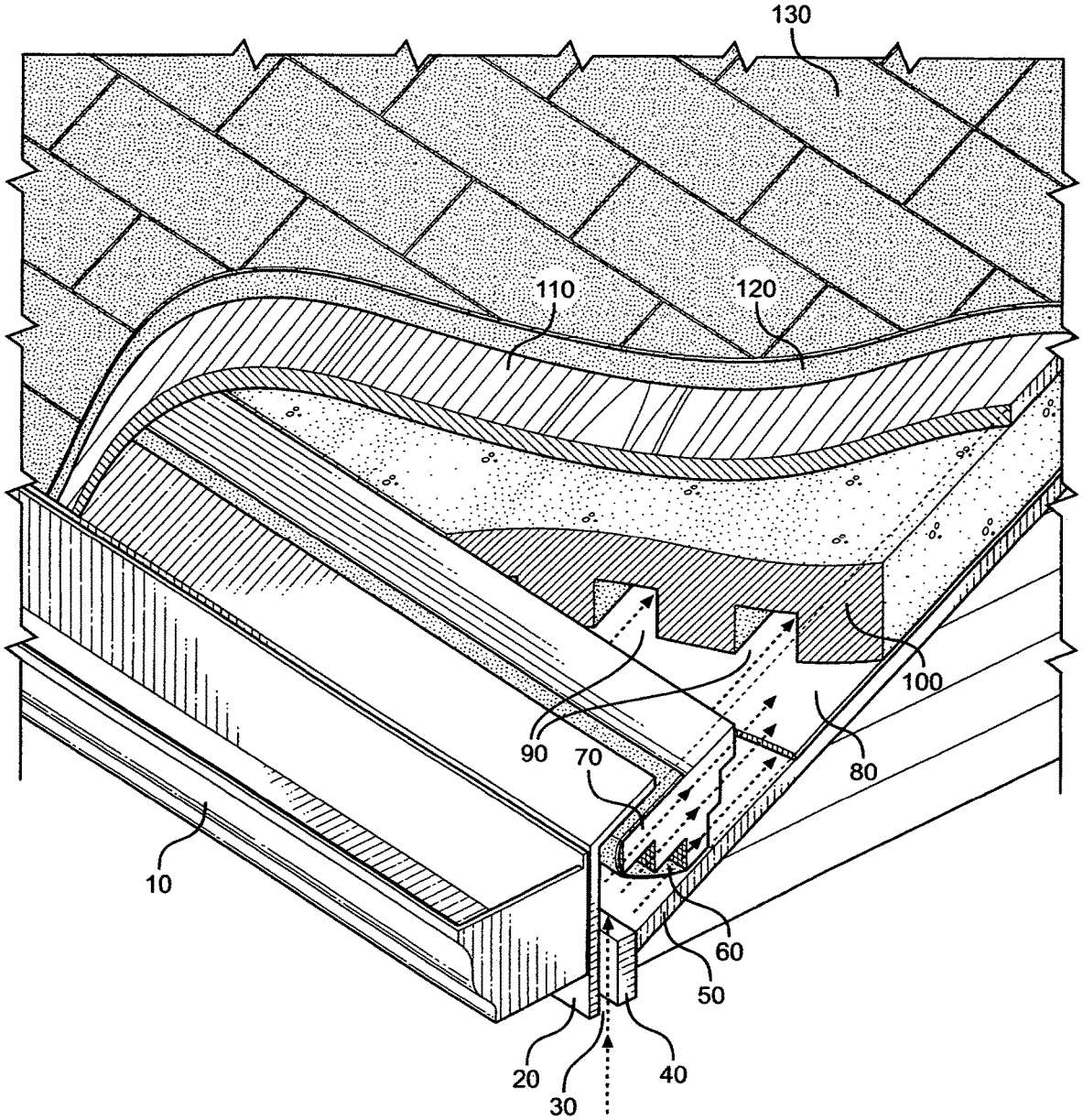
FIG. 1 shows a cut away view of a roofing system (in this illustration a gable roof) with the reflective barrier, venting insulation panel and the entry air flow direction.

FIG. 1 This invention is meant for use on either flat or pitched roofs. In FIG. 1 the example used to illustrate this invention is a sloped gable roof with asphalt shingles as the exterior roofing surface. Any profile of roofing material can be used. From bottom to top #10 is the gutter system that may or may not be used as this is just for illustration, the gutter system is not a part of the invention. If desired it is attached to and through the metal drip edge preferably but not exclusively with a hidden hanger system common to gutter systems. #20 is an eave drip edge commonly made of a type of metal or aluminum. It extends above the flow through vent #70 and is attached by fasteners through the flow through vent #70 into the deck #50 of the roof structure.

#90 is the air flow direction and enters the invention through the gap #30 between the eave drip edge and the fascia #40. Then the air #90 passes through the #60 insect and bug screen, keeping insects out of the roofing system. The air #90 then continues through the flow through vent #70 comprised of panels with air channels, sandwiched on top of each other in a way that air flows freely through the flow through vent. After the air #90 passes through the flow through vent #70 it continues in an upward direction passing over the #80 reflective barrier. This #80 reflective barrier is perforated with holes throughout its surface so that vapor can pass through it but water molecules cannot penetrate it. In this way it can also act as a waterproofing membrane during construction but still allows any condensation that occurs between the #80 reflective barrier and the roof structure decking #50 to flow through these penetrations and evaporate as the #30 air flows over it on its journey through the #100 vented and insulated panel. This reflective membrane #80 is made of a type of material that has a reflective rating of over 95% so that it will act as a radiant barrier and thus reflect a majority of the reflective or radiant heat that is caused by the sun's rays. This reflective barrier #80 or radiant barrier shall be bonded to a strong center fabric thus providing a strong membrane to walk on and less likely to tear and be a safety concern. This reflective membrane #80 must be adjacent to an air gap such as the #100 panel contains or its ability to reflect the radiant heat away from the structure will be greatly compromised. In some cases the #100 panel also can be installed directly on the roof deck with the grooves facing up and then the #80 reflective membrane can be installed over the grooves in the panel.

Reflective barrier or Radiant barrier #80 that provides a means by which radiant heat waves are reflected away from the roof and attic structure to cause cooler temperatures thus reducing the energy needed to cool the structure. An air gap is needed for the radiant rejection to work and is present using air channels adjacent to the radiant barrier on the underside of the thermal break.

The reflective barrier or radiant barrier #80 is vapor permeable to allow water vapor or condensation to permeate the membrane and then be dried by the ventilated air in the ventilation system.

The reflective barrier or radiant barrier #80 is water proof and does not allow water molecules to penetrate it thus adding another component to waterproof the roof structure or dry in the roof structure during construction.

The reflective barrier or radiant barrier #80 is double sided and has at least a 95% reflectivity that will radiate away from the structure during the hot months of the year.

The reflective barrier or radiant barrier #80 shall be bonded to a strong center fabric thus providing a strong membrane to walk on and less likely to tear and be a safety concern.

The reflective barrier or radiant barrier #80 is a unique feature of this invention.

These #100 insulated panels are made of a type of insulated material that acts as a thermal break so as to slow or stop the transfer of cold or heat depending on the outside temperature.

Thermal break #100 that provides a means by which an insulated panel is installed adjacent to the radiant barrier and insulates the roof from passing the hot or cold temperature on the membrane of the roofing system into the roof structure.

The thermal break #100 stops or greatly reduces thermal bridging over entire roof structure. Thermal bridging occurs when any part of a roofing structure is not insulated from direct contact with any part of the roofing structure that comes into direct contact with the outside ambient air.

The thermal break #100 allows for vertical air channels #90 to allow the radiant barrier the air gap it needs to be effective and the air pathways for ventilating hot air out of the roof structure.

The thermal break #100 also adds R value insulation depending on its density and thickness.

These #100 panels have grooves running from top to bottom throughout the #100 panel allowing air to flow along these grooves #90 from the entry at the eave to exit near the ridge. This air flow #90 will remove the hot air #90 that the radiant heat of the sun has caused because of the law that hot air rises and as it exits the invention at the ridge causing cooler air to be drawn in through the eave drip edge system #30 eave drip edge, #40 fascia, #60 insect and bug screen & #70 flow through vent making this process continuous and constant.

Figure 2:
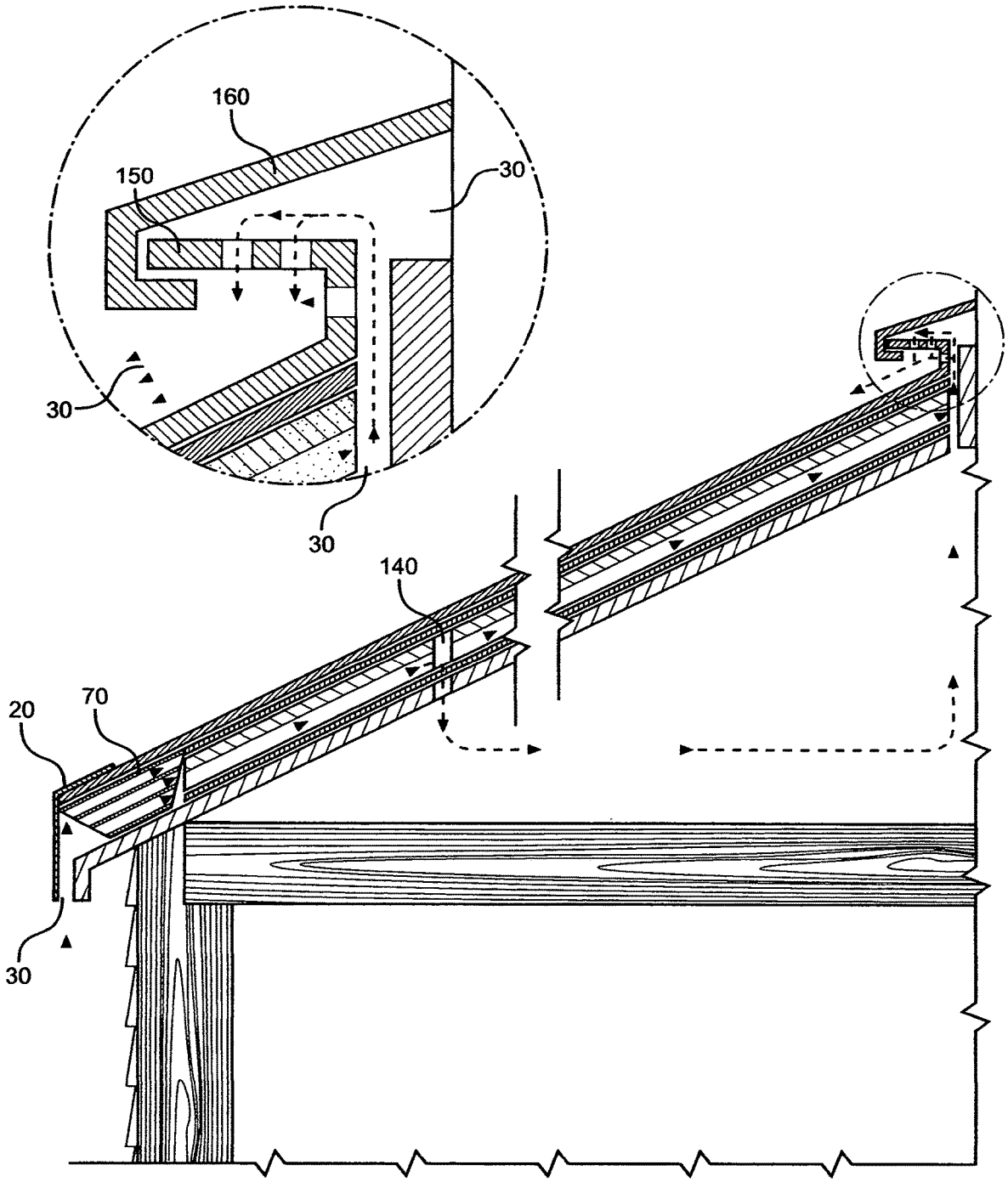
FIG. 2 shows a cut away side view of this invention from eave to ridge with a close up view of the ridge venting system for this invention.

In this particular illustration there is a solid deck #50 common to the entire roof structure as is common in residential construction. To allow the attic space to ventilate better a slice/gap #140 is introduced into the solid deck #50 (as seen in FIG. 2. This lets air into the space below the deck ventilate. As air enters through the #140 slice in the #50 deck it exits out of the ridge vent #150 at the apex of the roofing structure (as seen in FIG. 2). This cools or ventilates the attic air space. In commercial construction or older existing buildings a solid roof deck may not be present, instead a wood or metal purloin system or skip sheathing or some similar deck may be in place. This invention will work with any type of roofing deck.

After the slice #140 has been cut into the roof deck #50 and after the reflective membrane #80 has been installed over the entire roof deck and a slice has been removed from the reflective membrane #80 over the air gap #140 so air #90 can freely enter the attic space and the insulated and grooved panels have been installed over the entire roof deck in such a way as the grooves run continuously from bottom to top allowing air #90 to freely flow to the ridge vent assembly at the ridge of the roof then another deck of material #110 is installed to provide the required nailable surface to fasten the chosen roofing material to the roof deck #110 whether it be wood or some other roofing material. After the approved deck #110 has been installed then a water proof membrane #120 can be installed according to the manufacturer's instructions. Lastly a roofing membrane #130 can be installed as per the manufacturer's instructions. Any roofing material #130 can be installed on this invention without compromising its integrity or its ability to work as intended. The roofing surfaces that can be installed on this nailable surface can be asphalt shingles, wood shakes, any profile of metal roofs, clay or concrete tile but are limited to these roofs.

A Convective air ventilation system that provides a means by which the hot air is exited through a vented ridge cap and cooler air is drawn in from an eave venting system. This hot air is carried away from the roof system via the air channels used to make the radiant barrier operable. The cool air that is drawn in through the eave venting system also introduces cool air into the attic area via the slice #140 in the deck #50. As the hot air escapes through the vented ridge cap more cool air is drawn into the attic and also into the air channels on the underside of the thermal break insulated panels #100.

The ventilation system provides a means by which an attic under the ventilation system can be cooled, for example in one attic the air temperature at the apex of the attic measured 150 degrees Fahrenheit prior to the ventilation systems installation. The outside ambient air temperature was 95 degrees Fahrenheit. After said air ventilation system was installed the attic air temperature in the apex of the attic on a similar 95 degree day measured 103 degrees Fahrenheit. This particular system had a black asphalt shingle roof before and after the installation of said air ventilation system.

The ventilation system also provides a means by which the roof membrane or covering can be cooled. This will affect the longevity of most roof coverings or membranes especially asphalt and fiberglass shingles as well as wood shake roofs, for example a well-ventilated wood shake roof in arid Colorado can easily experience 2 to 3 times the average life as that of a non-ventilated roof in the Mid Atlantic. Many asphalt shingle roof warranties are significantly affected if proper ventilation is not included.

The ventilation system provides a means by which cooling the attic and the roof surface lowers the energy used to cool the structure in the hot months, for example one house using this system experienced a drop in attic temperature of 50 degrees Fahrenheit and was able to cool a finished room in the attic space from 95 degrees Fahrenheit to 75 degrees Fahrenheit using less energy than before the said air ventilation system was installed.

The air ventilation system provides a means by which moist humid air can be vented from the attic of a structure thus lowering the possibility of mold and mildew occurring.

The air ventilation system may be enhanced by adding solar powered fans in the apex of the roof or under the ridge cap. These fans may be powered by either a solar panel attached to the roof or attached to the electrical system of the structure. They may have a timer, or be thermostatically controlled or operate whenever the sun shines. This added ventilation will increase the efficiency of the entire system.

If this system utilizes a structural type thermal break, for example a polyurethane or similar type material that is structural in construction then it could become part of the building structure and span a considerable distance thus saving on labor and material on rafters and similar building components.

FIG. 2

FIG. 2 is a side view of the invention with a blow up or close up of the ridge vent area. In FIG. 2 the illustration shows, as in FIG. 1, how the air #30 enters through the gap created at the eave between the drip edge #20 and the fascia #40. This air #30 travels through the bug mesh #60 and then through the flow through vent #70 and enters the insulated panel #100. In this illustration we are able to see how the air flow #36 not only continues upward through the grooved panel #100 but also through a gap in the deck #140. This allows for more air flow in the attic. This additional air #30 introduced into the attic will rise and exit through the ridge vent #150 and cools the attic air temperature as well as the roof temperature.

In the close up view the illustration depicts the air flow #30 coming up from the attic space exiting though the vented ridge vent #150 as well as the air flow #30 from the grooved insulated panels #100 exiting the vented ridge vent #150.

The vented ridge vent #150 is comprised of a vented or perforated metal, or similar material, J channel that is fastened through to the roof structure deck #50. In the case of a gable roof there is a mirror image or process on the adjoining slope. A solid ridge cap #160 is then attached to the two J channels forming a solid water proof cap along the entire ridge, or in some cases hip.

FIG. 3

Figure 3:
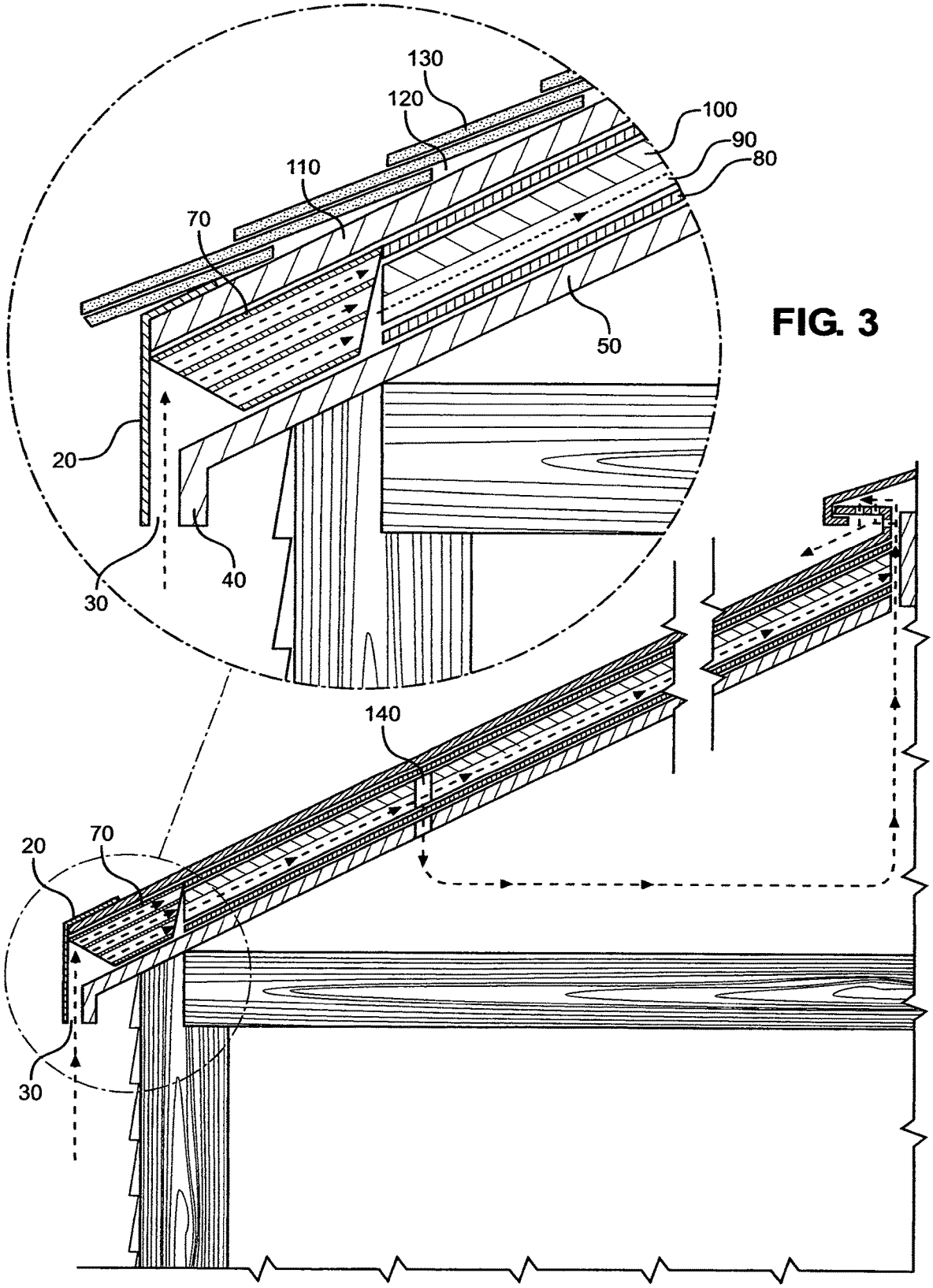
FIG. 3 shows a close up side view of the eave drip edge area and how the air enters through the flow through vent and into the grooved and insulated panel.

FIG. 3 is an illustration of a close up view of the eave area of the invention. Take special note of how the flow through vent #70 is in the shape of an inverted pyramid. Using this shape assures that if the upper exterior edge of the flow through vent #70 is located directly above the outside edge of the fascia #40 then there will be an air gap large enough to allow for sufficient air flow #90 and #30 for the invention to work. In some cases an air permeable mesh made of metal or plastic or nylon or similar material may take the place of the flow through vent. This mesh material must be of sufficient density and strength to not be flattened As illustrated in this close up a slice #140 is first introduced or cut into the deck #50 and then the reflective barrier #80 is installed on the roof deck #50, being careful to remove a corresponding amount of reflective barrier #80 to allow air #90 and #30 to enter the attic air space and then the insulated and grooved panels #100 are installed in this illustration with the grooves facing the deck #50, and adjacent to the reflective barrier #80. This reflective or radiant barrier #80 should have a 95% reflectivity to be effective. The air flow through the insulated grooved panels #90 then follows the grooves upward. In this example another nailable deck surface #110 is installed on top of the grooved and insulated panel #100. If, for example, a standing seam metal roof were the chosen roof surface then the additional roof deck #110 would not be needed as the standing seam roof has the ability to be attached by fasteners that would penetrate the entire system through to the original roof deck #50. If the secondary roof deck #110 is used due to the need for a nailable surface then a water proof membrane #120 may be used. The #130 roof material is then applied with the appropriate fasteners.

FIG. 4

Figure 4:
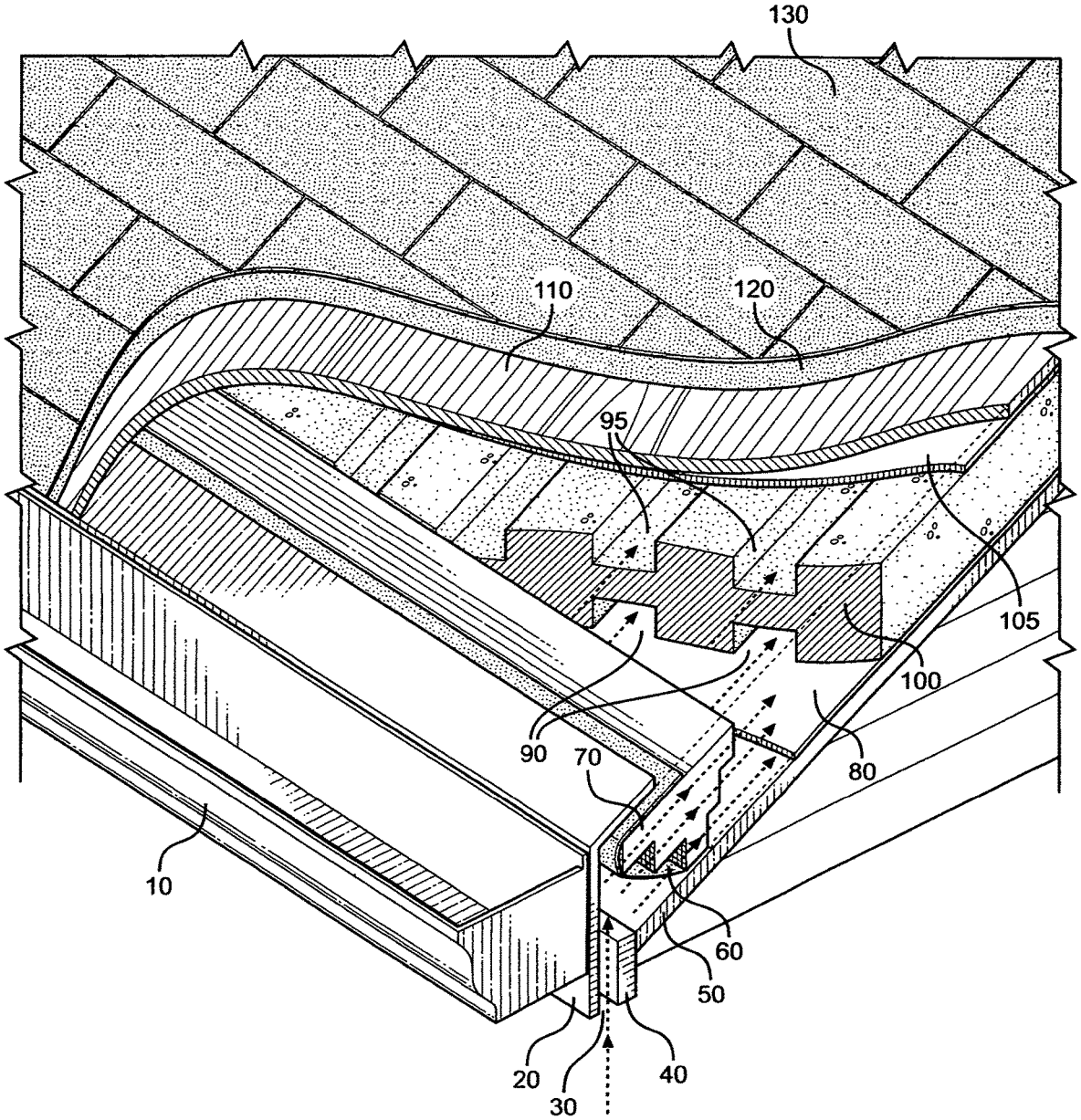
FIG. 4 shows a cut away view of a roofing system (in this illustration a gable roof) with the reflective barrier, double grooved venting insulation panel and the entry airflow direction.

FIG. 4 is a view of a double grooved insulated panel #100. A radiant barrier #80 is installed underneath the double grooved insulated panel #100 as well as on top #105. This allows for air #90 to flow through the lower grooves #90 as well as enter the gap #140 (as seen in FIG. 2) in the deck #50 into the attic space while the air #90 flows through the upper grooves #95 and travels up the air channels #95 and exits out of the vented ridge vent along with the air from the lower grooves #90 as well as the air from the attic space (as seen in FIG. 2). This double grooved insulated panel #100 allows for significantly more ventilation and air flow and is more effective in cooling the roof structure as well as the attic space.

FIG. 5

Figure 5:
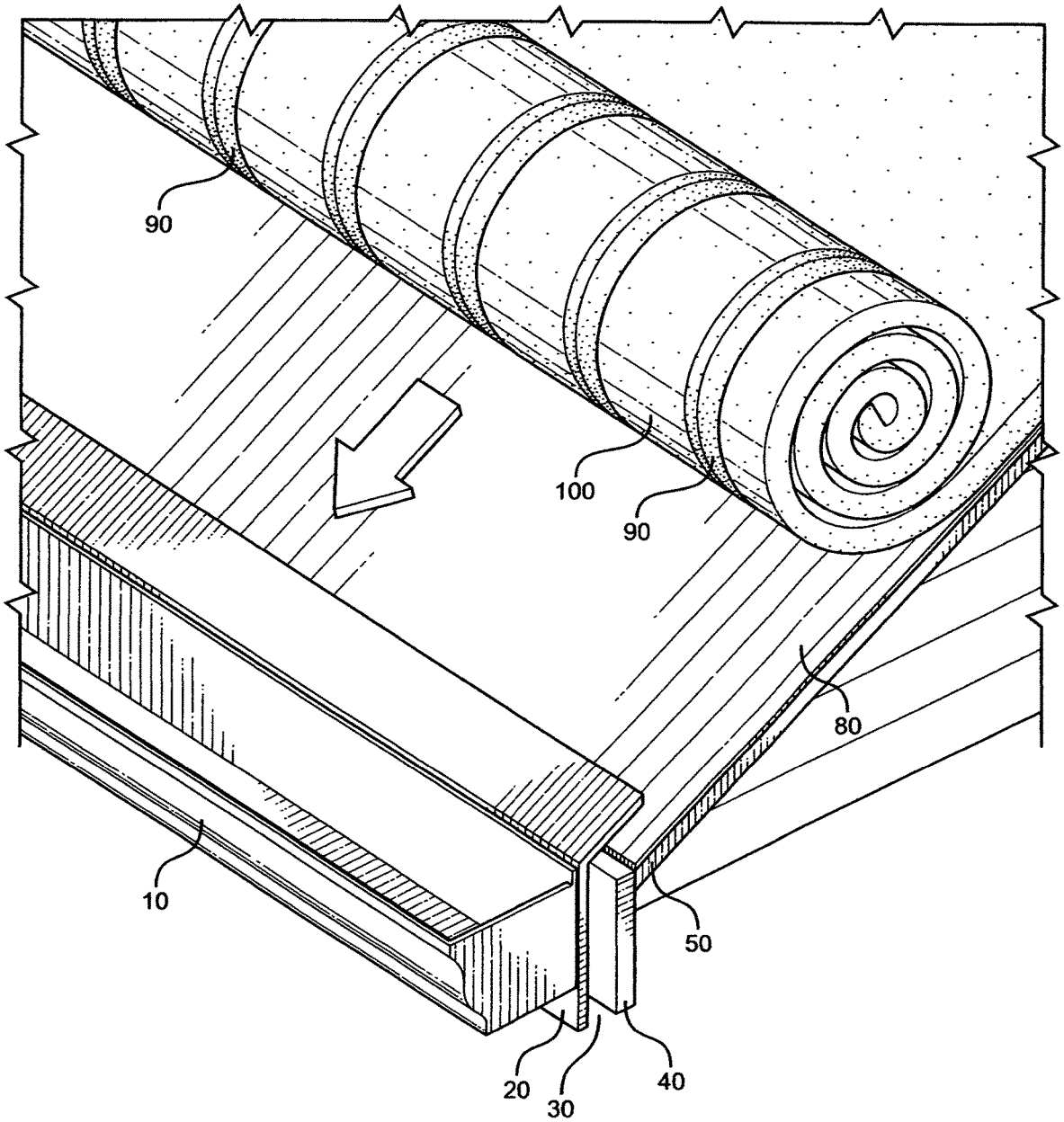
FIG. 5 shows a flexible type of this grooved insulation panel with the grooves face down. This application is easier to install since the material is continuous from ridge to eave.

FIG. 5 is a view of a roll type of this insulated #100 and grooved panel #90 rolled in one continuous length from ridge to eave. This method will help with ease and quickness of installation as it will be thinner and weigh less than the rigid panel style employed in FIG. 1. All other aspects of installation and application are the same between the rigid panel application of FIG. 1 and the flexible application of FIG. 5.

Figure 6:
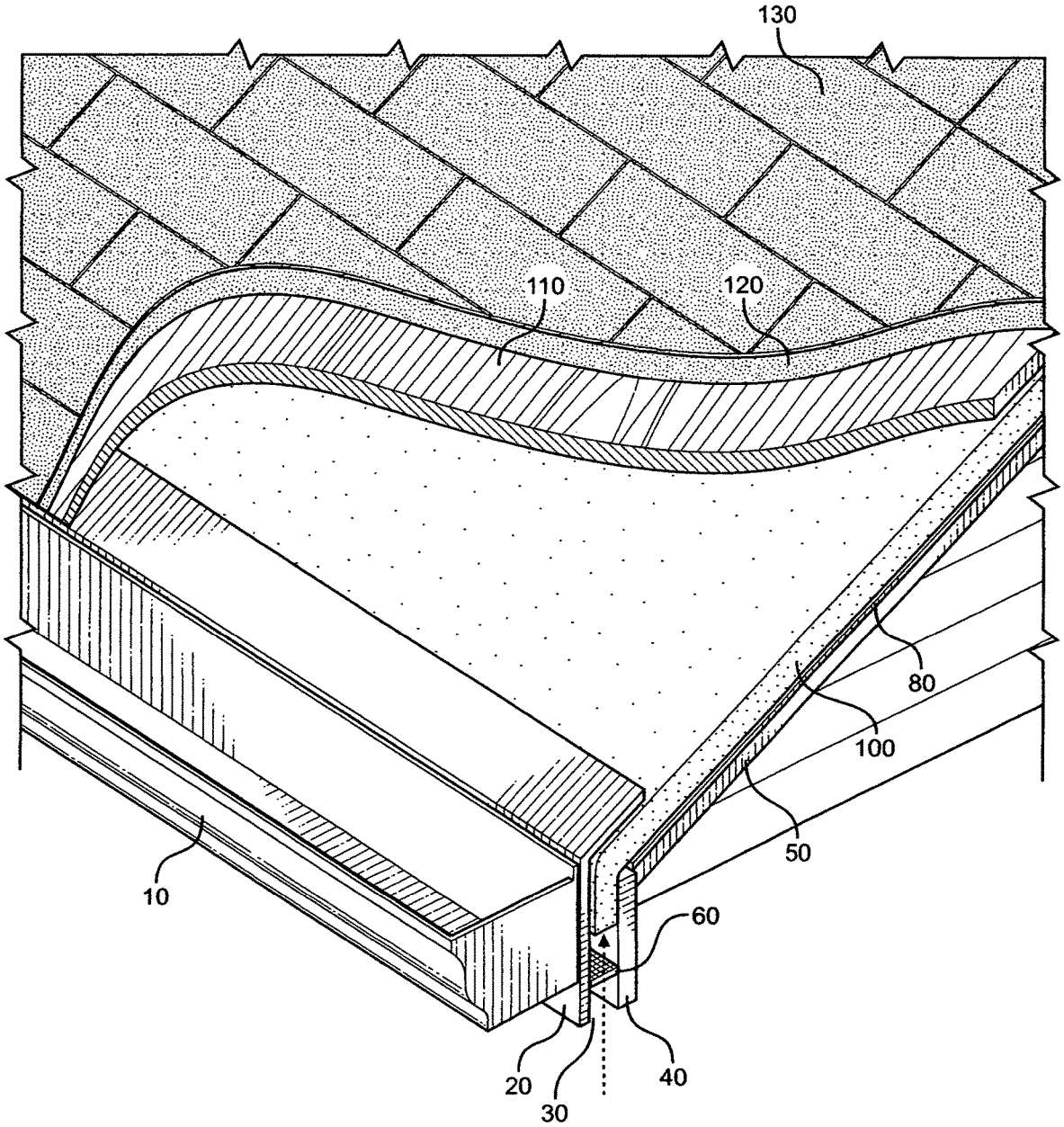
FIG. 6 Is a cross section view of the flexible grooved insulation panel once it has been installed with the grooves downward.
Figure 7:
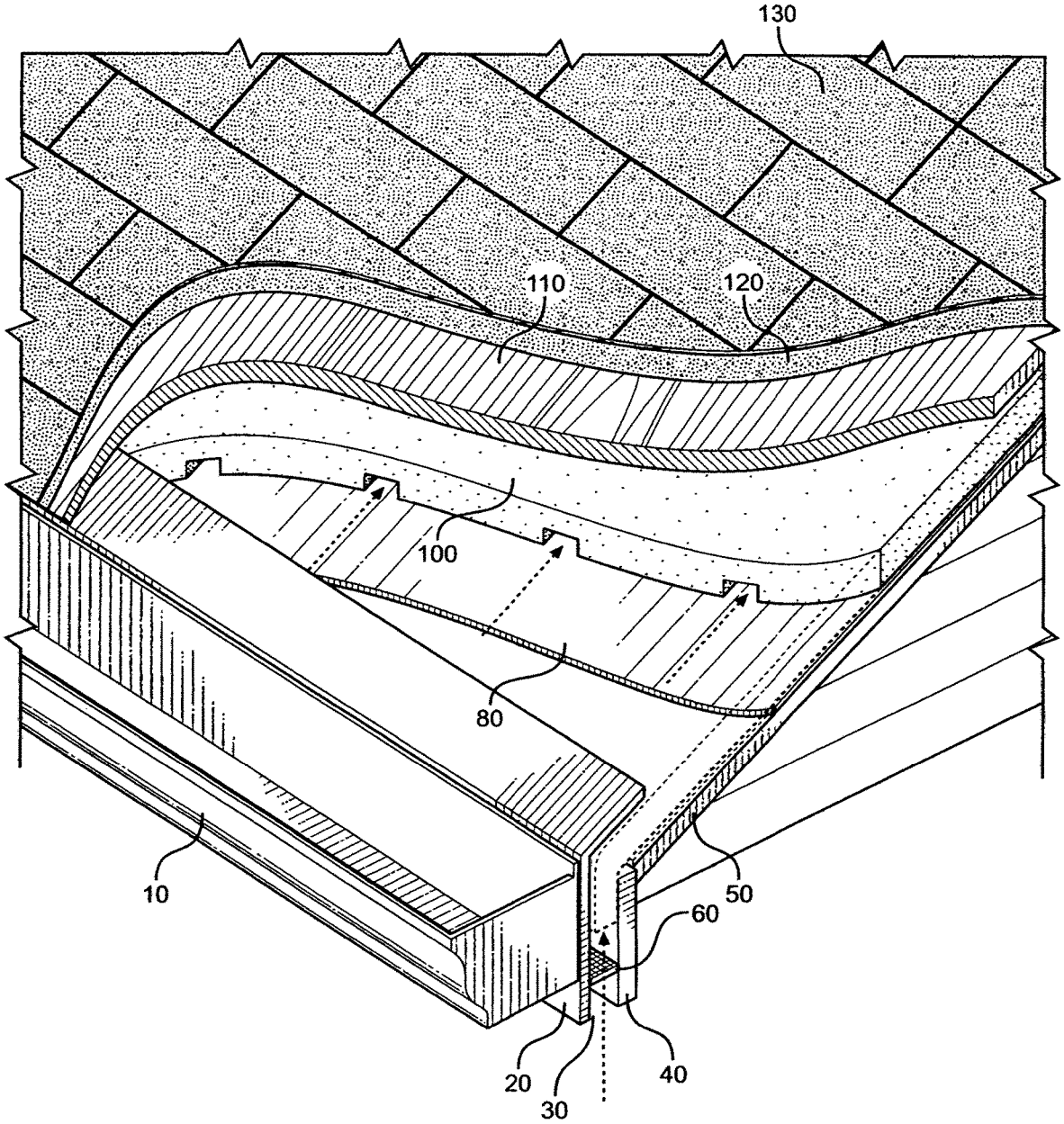
FIG. 7 Is a cut away view of the entire flexible grooved insulation panel installed on a gable roof deck. Note that except for it's comparable difference in thickness it is identical to FIG. 1.

FIG. 6 is a cut away view of the flexible roll type insulation panel installed on a roof deck with the grooves down as well as the components of this invention that are present to FIG. 1-4. FIG. 7 Shows a cut away view of the flexible roll type insulation panel as it would appear installed on a similar roof deck as FIG. 1. Note that the only noticeable difference is that the rolled type grooved insulation panel is thinner than the stiff insulation panel and therefore lighter and easier to install.

What is claimed is:

1. A self ventilating roof system comprising:

a roof structure comprising:

a deck having an upper surface and a lower surface that covers an open space below said roof structure, said deck having an upper end and a lower end opposite said upper end, said upper end being at a higher elevation than said lower end;

a vented eave located at said lower end of said deck, a slice in said deck creating a channel, whereby said channel is configured to permit air to travel from said vented eave to said open space, a vented ridge located at said upper end of said deck, and roofing material covering an entire area of said deck, said roofing material extending from the vented eave to said vented ridge;

a reflective barrier on an upper surface of said deck, said reflecting barrier comprising a membrane that is reflective on both sides, said reflective barrier comprising perforations to permit vapor to pass through but prohibit water from passing through, said membrane being located on an upper surface of said deck and adjacent said roofing material, and being configured to block admission of radiant energy;

a thermal break installed between said reflective barrier and said roofing material, said thermal break comprising an insulated panel having an R value greater than one and having an upper surface and a lower surface with the lower surface being located adjacent to said reflective barrier and the upper surface being located adjacent the roofing material;

wherein said thermal break insulates said reflective barrier and said roof structure from external heat and cold;

said thermal break extending from the vented eave to the vented ridge and including a set of parallel upper grooves in the upper surface and a set of parallel lower grooves in the lower surface for conducting heated air through the roof system from the vented eave to the vented ridge.

2. The self ventilating roof system of claim 1, wherein said reflective barrier is at least 95% reflective of radiant energy.

3. The self ventilating roof system of claim 1, wherein said insulated panel comprises a rigid foam.

4. The self ventilating roof system of claim 1, wherein said roofing material is selected from the consisting of asphalt shingles, wood shakes, metal panels, clay tiles and concrete tiles.

5. The self ventilating roof system of claim 1, wherein the insulated panel is flexible.

* * * * *